US005154650A

United States Patent [19]

Nakase

[11] Patent Number: 5,154,650

[45] Date of Patent: Oct. 13, 1992

[54] WATER JET PROPULSION UNIT

[75] Inventor: Ryoichi Nakase, Hamamatsu, Japan

[73] Assignee: Sanshin Kogyo Kabushiki Kaisha, Hamamatsu, Japan

[21] Appl. No.: 562,217

[22] Filed: Aug. 3, 1990

[30] Foreign Application Priority Data

Aug. 3, 1989 [JP] Japan ..... 1-200392

[51] Int. Cl.[5] ..... B63H 11/11

[52] U.S. Cl. ..... 440/41; 440/40; 114/270

[58] Field of Search ..... 440/39, 40, 41; 114/145 A, 270

[56] References Cited

U.S. PATENT DOCUMENTS

| | | | |
|---|---|---|---|
| 2,751,875 | 6/1956 | Henry | 114/145 A |
| 3,105,353 | 10/1963 | Schulz | 440/41 |
| 3,117,548 | 1/1964 | Rasmussen | 114/145 A |
| 3,127,741 | 4/1964 | Pottharst | 440/41 |
| 3,143,857 | 8/1964 | Eaton | 440/41 |
| 3,209,534 | 10/1965 | Stallman | 440/41 |
| 3,266,733 | 8/1966 | Goehler | 440/41 |
| 3,272,439 | 9/1966 | Rosentrater | 440/41 |
| 3,336,752 | 8/1967 | Smith | 440/41 |
| 3,347,203 | 10/1967 | Starry | 440/41 |
| 3,906,885 | 9/1975 | Woodfill | 440/41 |
| 3,945,201 | 3/1976 | Entringer | 440/41 |
| 3,965,838 | 6/1976 | Uht | 114/145 A |
| 4,047,494 | 9/1977 | Scott | 440/41 |
| 4,708,671 | 11/1987 | Watanabe | 440/41 |

FOREIGN PATENT DOCUMENTS

| | | | |
|---|---|---|---|
| 56-75296 | 11/1981 | Japan . | |
| 9288 | 12/1988 | World Int. Prop. O. | 440/41 |

*Primary Examiner*—Sherman D. Basinger
*Assistant Examiner*—Thomas J. Brahan
*Attorney, Agent, or Firm*—Ernest A. Beutler

[57] ABSTRACT

A jet propulsion unit for a small watercraft that incorporates a mechanism for actuating the reverse thrust bucket through an intermediate lever so as to permit a flexible cable to be employed that lies closely above the jet propulsion unit. The actuating device is constructed so as to provide self-locking of the reverse thrust bucket in at least one of its positions. Various linkage arrangements for achieving the interrelationship are disclosed.

13 Claims, 6 Drawing Sheets

WATER JET PROPULSION UNIT

BACKGROUND OF THE INVENTION

This invention relates to a water jet propulsion unit and more particularly to an improved reverse thrust bucket actuating the mechanism for such a unit.

Water jet propulsion units are well known and widely utilized for water vehicles. These units conventionally employ an impeller housing in which an impeller is contained and which draws water through a water inlet and which discharges it through a discharge nozzle for propulsion of the watercraft. Conventionally, a steering nozzle is mounted for pivotal movement about a vertically extending axis on the discharge nozzle of the jet propulsion unit so as to steer the associated watercraft. In conjunction with these types of arrangements, frequently there is also pivotally supported on the steering nozzle a reverse thrust bucket which cooperates with the steering nozzle so as to redirect the water issuing from the jet propulsion unit discharge nozzle so as to achieve a reverse thrust.

Since the steering nozzle is pivotally supported and is operated remotely as is the reverse thrust bucket, there then arise certain difficulties in positioning all of the control mechanism. That is, the mechanism for actuating the reverse thrust bucket, which pivots about a horizontally disposed axis, must not interfere with the mechanism that affects the steering of the watercraft and must also be effective to permit the reverse thrust bucket to pivot along with the steering nozzle. For this reason, it has been the normal practice to employ a flexible wire actuator for achieving both the steering operation and the operation of the reverse thrust bucket. However, the physical relationships with prior art constructions have been such that the reverse thrust bucket actuating flexible cable must extend along the upper end of the jet propulsion unit. In order to achieve good operation, the flexible actuator must be positioned at a fairly high height above the jet propulsion unit and this gives rise to obvious spatial problems.

It is, therefore, a principal object of this invention to provide an improved arrangement for actuating the reverse thrust bucket of a jet propulsion unit for a watercraft.

It is a further object of this invention to provide an improved and compact actuating mechanism for the reverse thrust bucket of a watercraft jet propulsion unit.

As has been previously noted, the reverse thrust operation is achieved by pivoting the reverse thrust bucket into confronting relationship of the discharge opening of the steering nozzle. As a result, there are substantial forces that act upon the reverse thrust bucket and which, in normal instances, tend to force the reverse thrust bucket back out of its neutral position. Although locking mechanisms may be employed, this can complicate the structure and also make the operation of the reverse thrust bucket more difficult.

Also, it is desirable to ensure that the reverse thrust bucket is held in its normal position when reverse operation is not required. This can result in the need for additional locking mechanisms.

It is, therefore, a further principal object of this invention to provide an improved reverse thrust bucket actuating mechanism that will self-lock the reverse thrust bucket at least one of its positions.

It is a further object of this invention to provide an actuating mechanism for the reverse thrust bucket of a water jet propulsion unit that will lock the reverse thrust bucket inherently in its operative positions.

SUMMARY OF THE INVENTION

This invention is adapted to be embodied in a reverse thrust assembly for a jet propulsion unit of a small watercraft or the like having a steering nozzle disposed at the discharge end of the jet propulsion unit and supported for pivotal unit about a generally vertically extending steering axis for steering of the associated watercraft. A reverse thrust bucket is supported for pivotal movement by the steering nozzle between a normal forward drive position and a reverse drive position. Actuating means are carried by the steering nozzle and cooperate with the reverse thrust bucket for controlling the movement of the reverse thrust bucket between its position.

In accordance with a first feature of the invention, flexible cable means extend along the upper portion of the jet propulsion unit to a remotely positioned location for operating the actuating means to position the reverse thrust bucket in either of its positions.

In accordance with another feature of the invention, the cooperation between the actuating means and the reverse thrust bucket is such so as to provide self-locking of the reverse thrust bucket in at least one of its positions.

DETAILED DESCRIPTION OF THE PREFERRED EMBODIMENTS OF THE INVENTION

Figure 1:
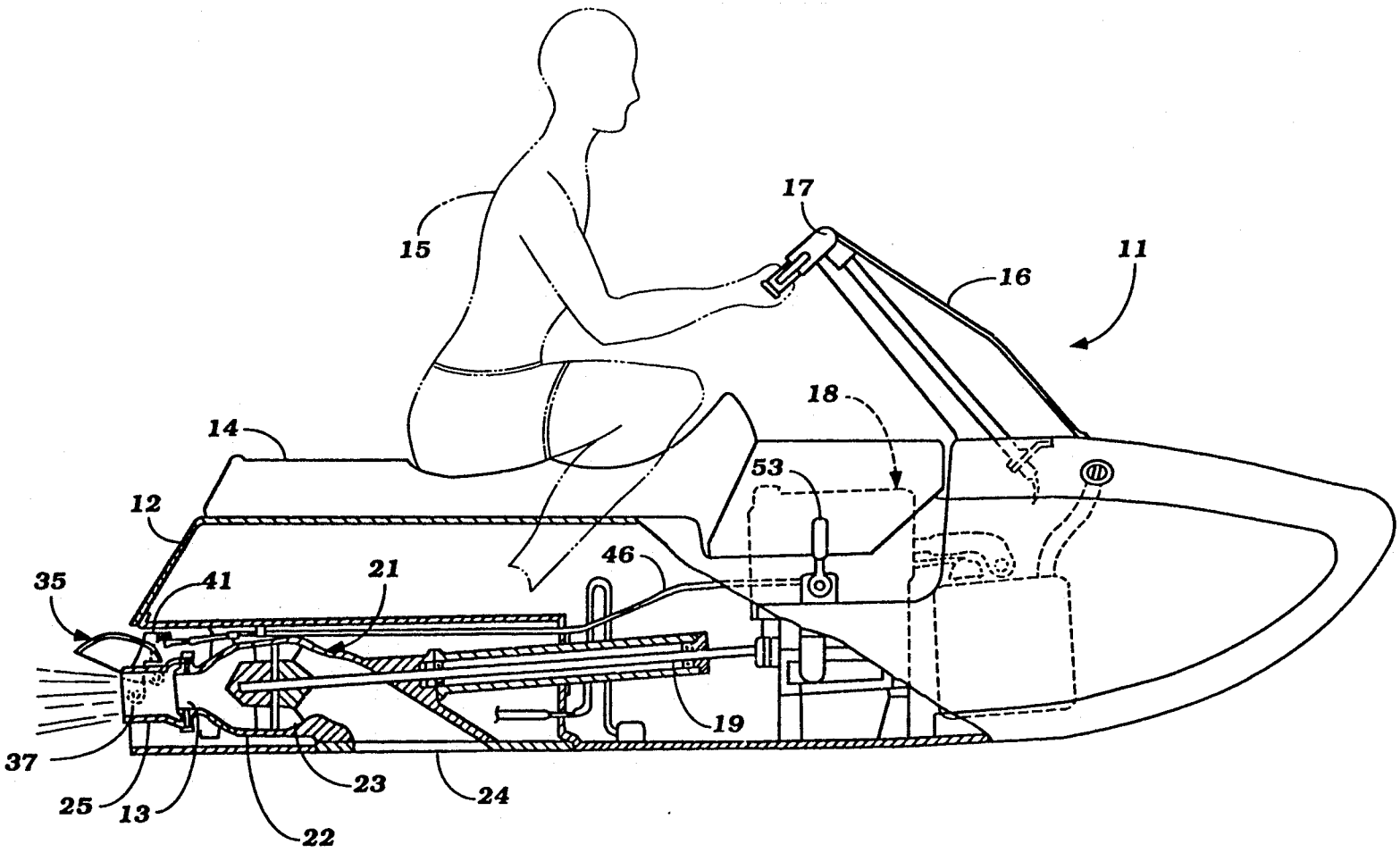
FIG. 1 is a side elevational view of a small watercraft constructed in accordance with an embodiment of the invention, with a portion broken away.

Referring first to FIG. 1, a small watercraft constructed in accordance with an embodiment of the invention as identified generally by the reference numeral 11. The small watercraft 11 is comprised of a hull which is formed from a molded fiberglass reinforced resin. A seat 14 is formed at the rear of the hull and is adapted to accommodate a single rider 15 seated thereon in straddle fashion. A raised bridge portion 16 is positioned forwardly of the seat 14 and contains a handlebar assembly 17 for steering of the watercraft in a manner to be described.

An engine compartment is formed within the hull beneath the bridge 16 and contains an internal combustion engine, shown schematically at 18 and which may be of any known type. The engine 18 drives a drive shaft 19 for a jet propulsion unit, indicated generally by the reference numeral 21. The jet propulsion unit 21 is comprised of an outer housing 22 that is mounted within a tunnel formed centrally of the rear portion of the hull 12 and in which an impeller 23 is rotatably journaled. The impeller 23 is connected for rotation with the drive shaft 19 and draws water through a water inlet 24 and discharges it past a straightening vane through a discharge nozzle 13 of the jet propulsion nozzle.

Figure 2:
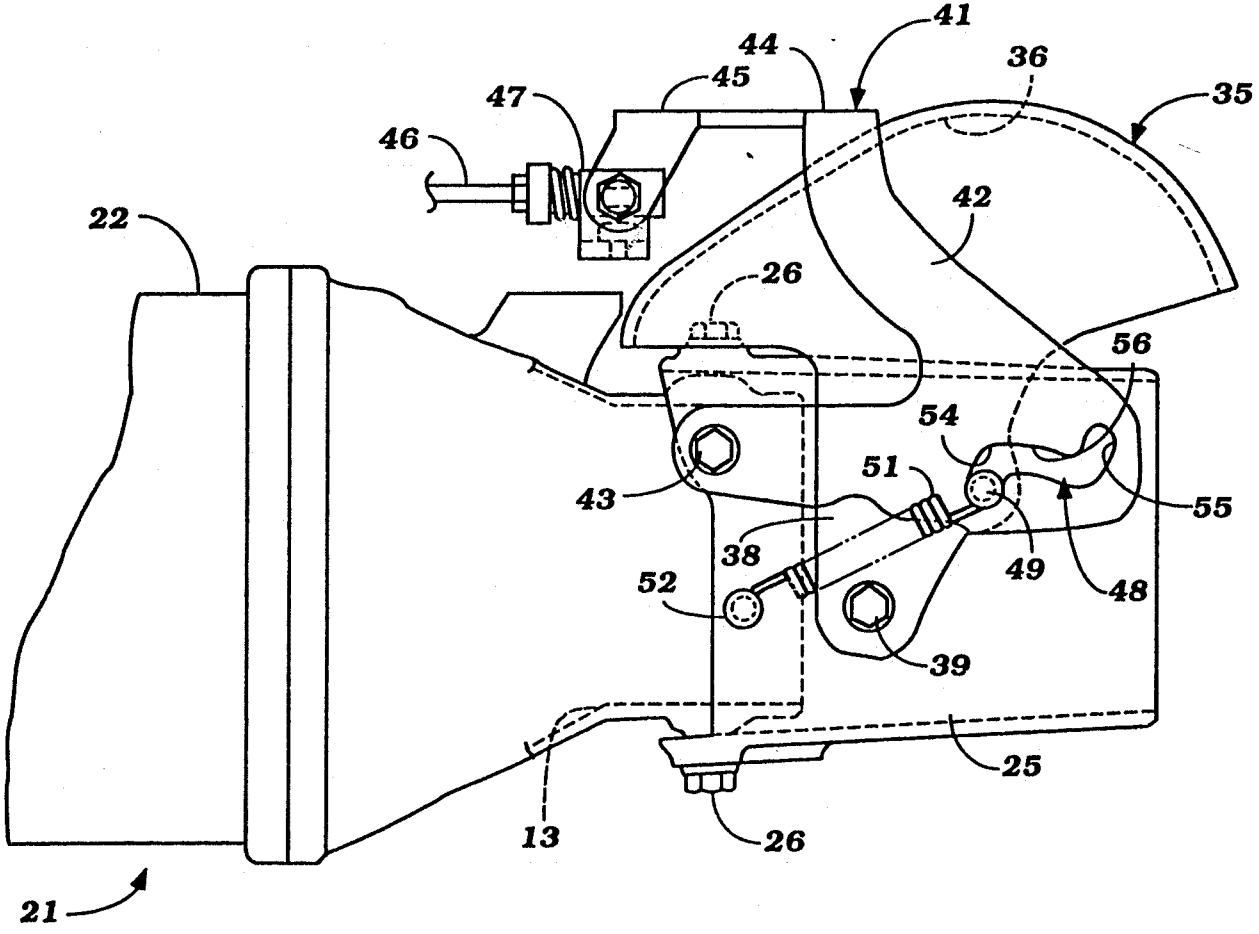
FIG. 2 is an enlarged side elevational view of the discharge portion of the jet propulsion unit, the steering nozzle and the reverse thrust bucket, showing the reverse thrust bucket in its normal forward drive position.
Figure 3:
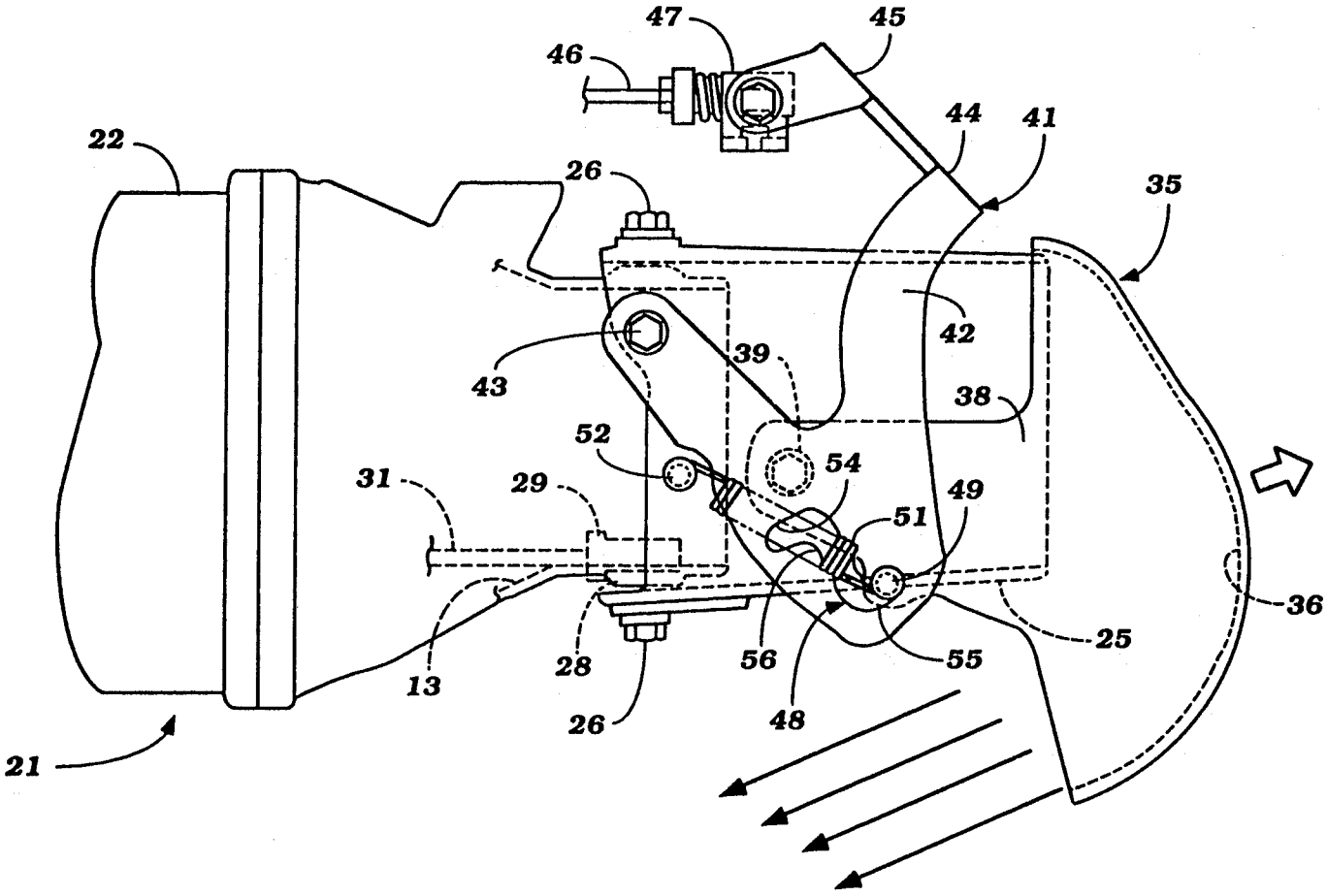
FIG. 3 is a side elevational view, in part similar to FIG. 2, and shows the reverse thrust bucket in the reverse thrust position.
Figure 4:
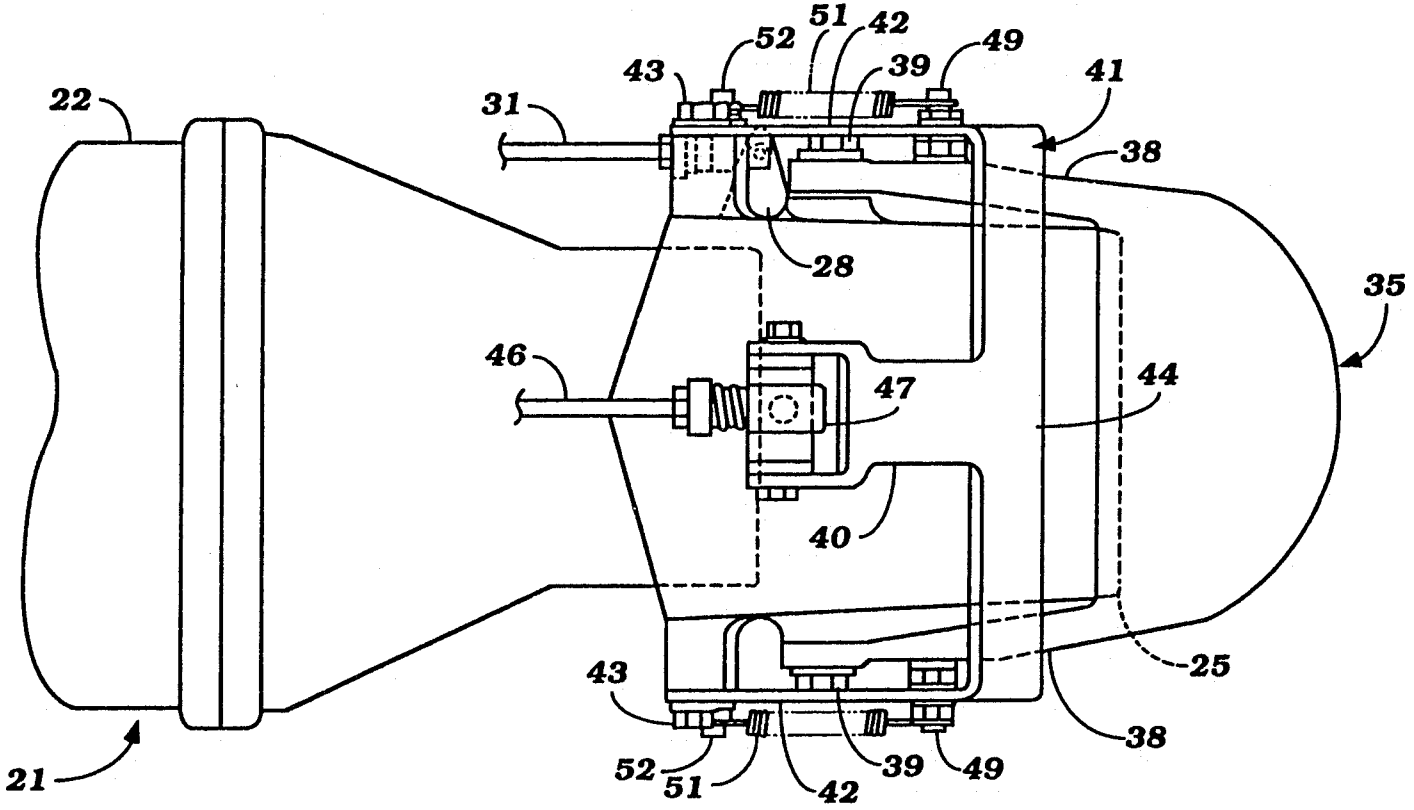
FIG. 4 is a top plan view of the portion of the construction shown in FIGS. 2 and 3 with a reverse thrust bucket being shown in the reverse position.

Referring now additional to FIGS. 2 through 4, it will be seen that a steering nozzle 25 is pivotally supported by means of a pair of vertically extending pivot pins 26 adjacent the discharge nozzle 13 of the main jet propulsion unit housing 22. A steering lever arm assembly 28 is affixed to the steering nozzle 25 and has a connection 29 to a wire actuator 31 that is coupled to the handlebar assembly 17 for steering of the steering nozzle 25 in a generally well-known manner.

In order to permit the watercraft 11 to be operated in a reverse mode, there is provided a flow deflecting reverse bucket assembly, indicated generally by the reference numeral 35 and shown in most detail in FIGS. 2 through 4. The reverse bucket assembly 35 has a central area 36 which is adapted to extend across the discharge end of the steering nozzle 25 and specifically a discharge opening 37 thereof to reverse the direction of thrust, as is well known in this art. The section 36 is connected to a pair of side sections 38 which are journaled on opposite sides of the steering nozzle 25 by pivot bolt assemblies 39.

An operating lever assembly, indicated generally by the reference numeral 41, has a generally inverted U shape and has a pair of side sections 42 that are pivotally supported upon the steering nozzle 25 adjacent the discharge nozzle portion 27 by means of a pair of pivot bolts 43. The side sections 42 are joined by a bridging section 44 that has a tang or lug 45 formed integrally thereon which is connected to an actuating cable 46 by means of a connector 47 for pivoting the operating lever 41 between the forward drive position shown in FIG. 2 and the reverse thrust position as shown in FIGS. 3 and 4.

The lever side portions 42 are each formed with generally Z shaped slots 48 that receive respective follower bolts 49 that are affixed to the sides 38 of the reverse thrust bucket 35. A pair of tension springs 51 are interconnected between the follower bolts 49 and pins 52 affixed to opposite sides of the steering nozzle 25 of the jet propulsion unit 21 for providing an over center locking to hold the reverse thrust bucket 35 in either its forward drive or reverse drive condition as will be hereinafter described.

The wire actuator 46 extends forwardly along the top of the jet propulsion unit 21 as best seen in FIG. 1 to a thrust bucket operating lever 53 that is positioned forwardly of the seat 14 and in proximity to the rider 15. Because of this relationship and the use of the interconnecting lever actuator 41, the wire actuator need not be positioned any significant heighth above the reverse thrust bucket 35 even when it is in its normal position and hence a very compact assembly can be provided.

Figure 5:
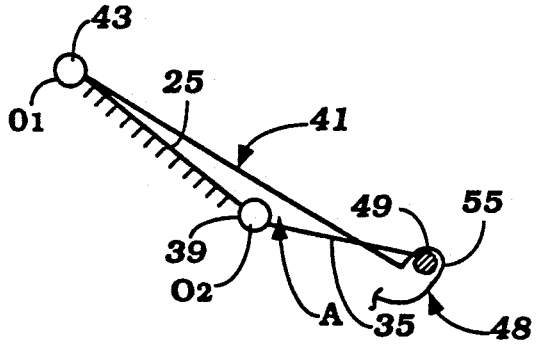
FIG. 5 is a partially schematic view showing the positioning of the actuating mechanism when the reverse thrust bucket is in its reverse position.
Figure 6:
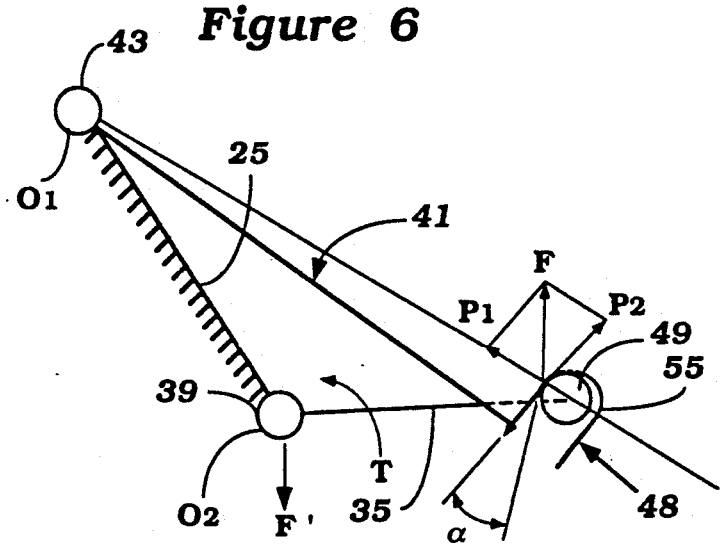
FIG. 6 is an enlarged view, in part similar to FIG. 5, and shows the forces operating on the mechanism during the reverse operating mode.
Figure 7:
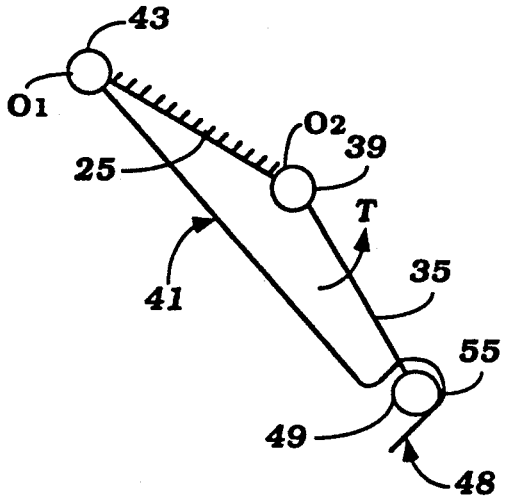
FIG. 7 is a diagrammatic view, in part similar to FIG. 5, and shows another embodiment of the invention.

Referring now to FIGS. 5 through 7 in conjunction with FIGS. 2 and 3, the operation of the Z-shaped slot 48 and its cooperation with the pins 49 and spring 51 so as to provide locking action in both the reverse drive and forward drive positions will be described. As has been previously noted, the slot 48 has a generally Z shape. This includes a forward drive leg 54, a reverse drive leg 55, and an interconnecting section 56 that completes the Z. As may be seen in FIG. 2, the relationship of the various pivot points and location of the spring 55 is such that when the mechanism is in its forward drive position, the spring 51 acts in an over-center relationship to the pivot bolts 39 of the reverse thrust bucket 35 so as to tend to hold the reverse thrust bucket in this position. However, when the mechanism shifted to the reverse drive position as shown in FIG. 3, the spring 51 goes over-center and the action of the spring 51 and the operation of the pins 49 in the slots 48 again hold the mechanism in its reverse thrust position. This self-locking operation also holds the reverse thrust bucket 35 in position when the watercraft 11 is transferred to or from a trailer or during trailering. Hence, the device is self-locking in each position.

In reference to FIGS. 5 and 6, the pivot pin location 43 is designated at 01 wherein the pivot pin location of the pivot bolt 39 is indicated at 02. These Figures show the reverse condition and it will be noted that the angle of the reverse portion 55 of the slot 48 is disposed so that a vector analysis would show that the cam pressure angle alpha is larger than zero but smaller than the frictional angle. This ensures that the device can be easily released upon operation of the wire actuator 46. The same can be achieved if the construction is reversed from that shown in FIG. 5 as shown in FIG. 6. In this instance, however, the action should be such that the pin 49 engages the opposite side of the slot portion 55.

It should also be noted that the geometric relationship is such that the distance between the follower bolts 49 and the pivot axis defined by the pivot bolts 39 (pivot axis $0_1$) is less than the distance between the follower bolts 49 and the pivot axis 03 defined by the pivot bolts 43 so that there is a mechanical advantage that will effect a greater degree of pivotal movement for the reverse thrust bucket 35 then a corresponding pivotal movement of the actuating lever 41. This permits the reverse thrust bucket 35 to be pivoted between its positions with a smaller amount of movement of the wire actuator 46 and a lesser degree of movement of the lever 53.

Also, it should be noted that the reverse thrust exerted against the reverse thrust bucket will be taken primarily through the pivot bolts 39 and 41 and very little or no force will be exerted on the cable 46 during reverse operations so that a light-weight wire actuator can be employed.

Figure 8:
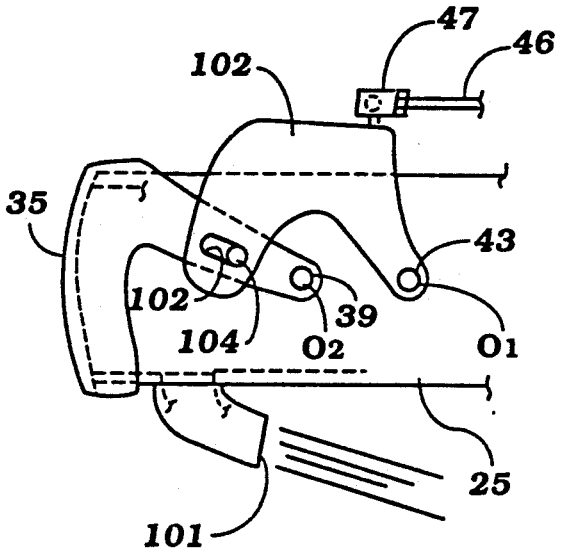
FIG. 8 is a side elevational view of a portion of a jet propulsion unit having a reverse thrust bucket constructed in accordance with another embodiment of the invention.

In the embodiments of the invention as thus far described, the wire actuator 46 is permitted to have a very compact relationship relative to the jet propulsion unit 21 and also a self-locking operation can be enjoyed. FIG. 8 shows another embodiment of the invention wherein a slightly different form of reverse bucket arrangement is provided and wherein the self-locking is achieved. In this embodiment it will be noted that the steering nozzle 25 has a reverse outlet 101 and its main outlet can be blocked by the reverse thrust bucket 35 that is again pivotally supported about pivot bolts 39 lying on the axis 02. An actuating lever 102 is pivotally supported on the pivot pins 43 and has a slot 103 in which a pin 104 on the reverse thrust bucket 35 is received. It should be readily apparent that movement of the wire actuator 46 will cause movement of the actuating lever 102 and movement of the reverse thrust bucket 35 from the reverse position to the forward position as previously described.

Figure 9:
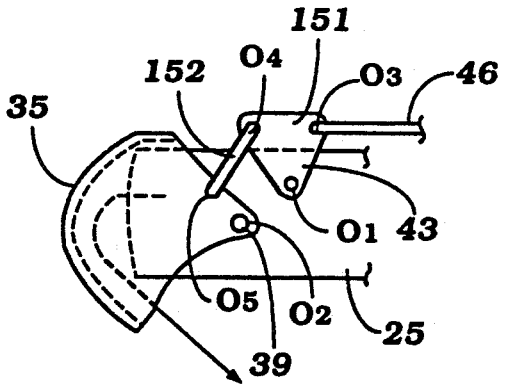
FIG. 9 is a side elevational view, in part similar to FIGS. 2, 3; 8 and 9 showing another embodiment of the invention.

FIG. 9 shows yet another embodiment of the invention wherein rather than a pin-in-slot connection the wire actuator 46 is connected to a belt crank-like member 151 that is pivotally supported on the pivot bolts 43. A link 152 interconnects a point 04 on the belt crank 151 to a point 05 on the reverse thrust bucket 35 for operating it in a manner which is believed to be obvious to those skilled in the art.

It should be readily apparent from the foregoing description that a number of embodiments of the invention have been illustrated and described and which provide a self locking function in at least the reverse drive position and which also permit a compact assembly due to the use of the intermediate actuating lever. Although several embodiments the invention are illustrated and described, various changes and modifications may be made without departing from the spirit and the scope of the invention, as defined by the appended claims.

I claim:

1. A reverse thrust assembly for a watercraft jet propulsion unit having a steering nozzle disposed at the discharge end of said jet propulsion unit and supported for pivotal movement about a generally vertically extending steering axis for steering of the associated watercraft, a reverse thrust bucket supported for pivotal movement by said steering nozzle between a normal forward drive position and a reverse drive position, an actuating lever pivotally carried by said steering nozzle on opposites thereof, the pivot axis of said actuating lever being parallel to the pivot axis of said reverse thrust bucket and cooperating with said reverse thrust bucket for controlling the movement of said reverse thrust bucket between said positions, flexible cable, means extending along the upper portion of said jet propulsion unit for operating said actuating means from a remote location, and means interconnecting said actuating means and said reverse thrust bucket and operative to provide a self-locking effect in at least one position of the reverse thrust bucket under which water forces on said reverse thrust bucket will hold said reverse thrust bucket in said one position.

2. A reverse thrust assembly as set forth in claim 1 wherein motion is transmitted from the actuating lever to the reverse thrust bucket through a pin-and-slot connection.

3. A reverse thrust assembly as set forth in claim 2 wherein the pin-in-slot connection is self-locking in at least one position of the reverse thrust bucket.

4. A reverse thrust assembly as set forth in claim 3 wherein the self-locking operation is operative in both positions of the reverse thrust bucket.

5. A reverse thrust assembly as set forth in claim 1 further including linkage means for interconnecting the reverse thrust bucket and the actuating lever.

6. A reverse thrust assembly as set forth in claim 1 wherein the operative connection provides a self-locking of the reverse thrust bucket in both of its positions so that water forces acting on said reverse thrust bucket will hold said reverse thrust bucket in each of said positions.

7. A reverse thrust assembly as set forth in claim 1 wherein the operative connection between the actuating means and the reverse thrust bucket comprises pin-and-slot connection.

8. A reverse thrust assembly as set forth in claim 7 wherein the pin-and-slot connection has an end portion in the one position operative to provide the self-locking.

9. A reverse thrust assembly for a watercraft jet propulsion unit having a steering nozzle disposed at the discharge end of said jet propulsion unit and supported for pivotal movement about a generally vertically extending steering axis for steering of the associated watercraft, a reverse thrust bucket supported for pivotal movement by said steering nozzle between a normal forward drive position and a reverse drive position, actuating means carried by said steering nozzle and cooperating with said reverse thrust bucket for controlling the movement of said reverse thrust bucket between said positions, means for operating said actuating means, and means including a pin-and-slot connection interconnecting said actuating means and said reverse thrust bucket and operative to provide a self-locking effect in both positions of the reverse thrust bucket under which water forces on said reverse thrust bucket will hold said reverse thrust bucket in said positions, said pin-and-slot connection having two end portions to provide the self-locking in the respective position of the reverse thrust bucket.

10. A reverse thrust assembly as set forth in claim 9 wherein the two end portions are straight portions extending generally parallel to each other and intersected by an angularly disposed portion that is effective to cause the movement of the reverse thrust bucket between its positions.

11. A reverse thrust assembly for a jet propulsion unit having a steering nozzle disposed at the discharge end of said jet propulsion unit and supported for pivotal movement about a generally vertically extending steering axis for steering of the associated watercraft, a reverse thrust bucket supported for pivotal movement by said steering nozzle between a normal forward drive position and a reverse drive position, actuating means carried by said steering nozzle and cooperating with said reverse thrust bucket for controlling the movement of said reverse thrust bucket between said positions, means for operating said actuating means, means interconnecting said actuating means and said reverse thrust bucket and operative to provide a self-locking effect in at least one position of the reverse thrust bucket under which water forces on said reverse thrust bucket will hold said reverse thrust bucket in said one position, and biasing spring means for holding said reverse thrust bucket in said one position.

12. A reverse thrust assembly as set forth in claim 11 wherein the biasing spring means comprises a single spring for biasing the reverse thrust bucket in each of its positions.

13. A reverse thrust assembly for a watercraft jet propulsion unit having a steering nozzle disposed at the discharge end of said jet propulsion unit and supported for pivotal movement about a generally vertically extending steering axis for steering of the associated watercraft, a reverse thrust bucket supported for pivotal movement by said steering nozzle between a normal forward drive position and a reverse drive position, actuating means carried by said steering nozzle and cooperating with said reverse thrust bucket for controlling the movement of said reverse thrust bucket between said positions, means for operating said actuating means, and means including a pin-and-slot connection interconnecting said actuating means and said reverse thrust bucket, said pin-and-slot connection having an end portion operative to provide a self-locking effect in at least one position of the reverse thrust bucket under which water forces on said reverse thrust bucket will hold said reverse thrust bucket in said one position, said end portion of said pin-and-slot connection being a straight section of the pin-and-slot connection intersected by an angularly disposed section that is effective to cause the pivotal movement of said reverse thrust bucket.

* * * * *